US011445768B1

(12) United States Patent
Dehlsen et al.

(10) Patent No.: US 11,445,768 B1
(45) Date of Patent: Sep. 20, 2022

(54) WOMEN'S TANK TOP WITH BUILT-IN BREAST SUPPORT

(71) Applicant: Purnell, LLC, Santa Barbara, CA (US)

(72) Inventors: James Brenton Dehlsen, Santa Barbara, CA (US); Brita Womack, Santa Barbara, CA (US)

(73) Assignee: Purnell, LLC, Santa Barbara, CA (US)

( * ) Notice: Subject to any disclaimer, the term of this patent is extended or adjusted under 35 U.S.C. 154(b) by 17 days.

(21) Appl. No.: 14/943,015

(22) Filed: Nov. 16, 2015

(51) Int. Cl.
*A41C 3/08* (2006.01)
*A41D 1/18* (2006.01)
*A41C 3/00* (2006.01)

(52) U.S. Cl.
CPC ..... *A41C 3/08* (2013.01); *A41C 3/0028* (2013.01); *A41D 1/18* (2013.01)

(58) Field of Classification Search
CPC .... A41C 3/00; A41C 3/04; A41C 3/06; A41C 3/08; A41C 3/0035; A41D 1/22; A41D 1/205; A41D 1/20; A41D 1/18
USPC ..... 450/36, 54–57
See application file for complete search history.

(56) References Cited

U.S. PATENT DOCUMENTS 2,341,032 A * 2/1944 Freed ..... A41C 3/08 2/67
4,398,538 A 8/1983 Johnson
4,440,174 A 4/1984 Cordova
5,478,278 A 12/1995 Greenblatt
6,336,840 B2 1/2002 Heroff
6,443,805 B1 * 9/2002 Kirkwood ..... A41C 3/0035 450/31
6,811,462 B1 11/2004 Kenneally
6,846,217 B1 1/2005 Struble et al.
7,430,883 B2 * 10/2008 Sorensen ..... A41D 1/205 450/36
7,488,234 B2 * 2/2009 Rothman ..... A41C 3/08 2/104
7,549,302 B2 6/2009 Duckham et al.
RE41,654 E 9/2010 Struble et al.
D669,660 S 10/2012 Savage
8,506,347 B2 8/2013 Clair et al.
8,568,195 B1 10/2013 Schindler
8,574,026 B2 11/2013 Livingstone
2007/0270078 A1 * 11/2007 Henry ..... A41C 3/0035 450/54
2008/0026676 A1 * 1/2008 Rothman ..... A41C 3/08 450/36

(Continued)

*Primary Examiner* — Gloria Hale
(74) *Attorney, Agent, or Firm* — Trevor Coddington; Insigne PC

(57) ABSTRACT

The present invention provides a garment comprising a soft, knit tank top with a built-in, floating bra. The bra cups and front bridge are constructed with the same fabric as the tank top. Bra cups connect to the tank top partially along front neckline and are double-layered to provide space for removable and inter-changeable sized inserts for different levels of coverage. A floating back panel is made with a single-layer of compression fabric to provide tension support and anchor the front. The straps of the tank top are double-layered shell fabric and connect at a top of the shoulder to wide, flat-lock stitched vertical back bra straps made with compression fabric. This tank top with built-in bra support is a bra replacement worn as a stand-alone top garment or a layering piece underneath outer layers.

18 Claims, 14 Drawing Sheets

(56) References Cited

U.S. PATENT DOCUMENTS

| | | | | |
|---|---|---|---|---|
| 2013/0047311 | A1* | 2/2013 | Morency | A41D 1/22 2/46 |
| 2013/0232661 | A1* | 9/2013 | Huntley | A41D 1/205 2/104 |
| 2014/0317823 | A1 | 10/2014 | Hanson | |

* cited by examiner

WOMEN'S TANK TOP WITH BUILT-IN BREAST SUPPORT

BACKGROUND OF THE INVENTION

1. Field of Invention

This invention relates to women's clothing and more specifically, to an upper garment, e.g., tank top, including a built-in undergarment, i.e., bra, for breast support.

2. Description of Related Art

Presently available women's apparel generally does not include breast support. Typically, a breast support system, such as a bra, is a component separate from an upper garment, e.g., shirt or dress. The upper garment and bra each have a separate strap arrangement for supporting the garment or bra over a woman's shoulders. One disadvantage of having a separate strap for the bra and for the garment is that the bra strap can be displaced from being completely covered by the garment shoulder strap. When a woman performs routine activities while wearing a two-piece garment and bra arrangement, exposure of the bra strap beneath the garment strap can present an unkempt look. This can be a particular problem when the shoulder support straps of the garment are thin, i.e., about the same width as the bra strap. In addition, the independent movement of the two straps on a woman's shoulder can be constantly irritating and require repeated manual adjustment to realign the bra strap and the garment strap.

One alternative arrangement is to attach an ordinary, standalone bra to an outer garment, e.g., U.S. Pat. No. 8,506,347, the entire disclosure of which is incorporated by reference herein. While this arrangement may provide adequate breast support, the bra and garment are fixed together at multiple portions of the body of the bra (i.e., cups, sides and back region) in addition to the strap region. This arrangement can be disadvantageous because the garment cannot move freely relative to the body of the bra.

Another alternative arrangement is the tank top with shelf bra, e.g., U.S. Pat. Nos. 4,440,174 and 7,488,234, the entire disclosures of which are incorporated by reference herein. A shelf bra is also known as a platform bra, quarter-cup bra, or cup-less bra. It provides breast support from an underneath wire or elastic strip, but has no cups or very short cups. While this arrangement is more comfortable than a traditional bra, the unstructured nature of the shelf bra design does not provide as support or shapeliness as traditional bras and women with larger breasts.

Another alternative is the sports bra top designed to give support during physical activity. While this design does provide flexibility in movement and more comfort than a traditional bra, like the shelf bra, the unstructured nature of the design, along with the elasticity of the compression fabric of which these bras are typically made, greatly reduces the shapeliness of the bust line which the wearer must sacrifice in exchange for comfort and support.

SUMMARY OF THE INVENTION

The present invention overcomes these and other deficiencies of the prior art by providing a garment comprising a soft, knit tank top with a built-in, floating bra. The bra's cups, front bridge, and front straps are all constructed with the same fabric as the tank top. The bra connects to the tank top partially along front neckline and is double-layered to provide space for removable and inter-changeable sized inserts for different levels of coverage. A floating back panel and back straps of the bra are made with a single-layer of compression fabric to provide tension support and anchor the front. Front straps of the tank top are double-layered shell fabric and connect at top of the shoulder to the wide, flat-lock stitched vertical back bra straps made with compression fabric. This tank top with built-in bra support is a bra replacement worn as a stand-alone top garment or a layering piece underneath outer layers.

In an embodiment of the invention, an article of clothing comprises: an outer shell comprising a left over-shoulder strap and a right over-shoulder strap; and an inner bra comprising a front portion and a back portion; the front portion comprises: a left cup, a right cup, a bridge connected to the left cup and the right cup, a left tapered section above the left cup, a right tapered section above the right cup; the back portion comprises: a back panel, a first back strap comprising a proximate end and a distal end, and a second back strap comprising a proximate end and a distal end, wherein the back panel is connected to the proximate end of the first back strap and the proximate end of the second back strap; wherein the left tapered section of the inner bra is connected to a lower front portion of the left over-shoulder strap of the outer shell along its neckline and a left armhole, and the right tapered section of the inner bra is connected to a lower front port of the right over-shoulder strap of the outer shell along its neckline and a right armhole; and wherein the distal end of the first back strap is connected to the left over-shoulder strap of the outer shell, and the distal end of the second back strap is connected to the right over-shoulder strap of the outer shell. The article of clothing can further comprise a first loop attached to a back shoulder portion of the left over-shoulder strap and a second loop attached to a back shoulder portion of the right over-shoulder strap, the first loop loosely holding in place the first back strap, and the second loop loosely holding in place the second back strap. The first back strap and the second back strap both comprise compression fabric, and the outer shell and the front portion of the inner bra do not comprise compressive fabric. The outer shell comprises a scalloped hemline and a bamboo/cotton knit fabric. In a preferred embodiment, the outer shell is a tank top and the front portion of the bra comprises a left strap connected to the left tapered section and a right strap connected to the right tapered section. The left strap is attached to the tank top along its neckline and left armhole, wherein the right strap is attached to the tank top along its neckline and right armhole. The left tapered section and the tank top form a left opening to receive an insert for the left cup, and the right tapered section and the tank top form a right opening to receive an insert for the right cup. The inserts comprise removable and interchangeably sized inserts. The left cup and right cup both comprise one or more darts.

In another embodiment of the invention, an article of clothing comprises: an outer shell; and an inner bra comprising a front portion and a back portion; the front portion comprises: a left cup, a right cup, a bridge connected to the left cup and the right cup, a left tapered section above the left cup, a right tapered section above the right cup; the back portion comprises: a back panel, a first back strap comprising a proximate end and a distal end, and a second back strap comprising a proximate end and a distal end, wherein the back panel is connected to the proximate end of the first back strap and the proximate end of the second back strap; wherein the left tapered section of the inner bra is connected to the outer shell, and the right tapered section of the inner bra is connected to the outer shell; wherein the distal end of the first back strap is connected to the outer shell, and the distal end of the second back strap is connected to the outer shell; and wherein the bridge and the back panel are not connected to the outer shell and are free to float relative to the outer shell. The first back strap and the second back strap both comprise compression fabric, and the outer shell and the front portion of the inner bra do not comprise compressive fabric. The outer shell comprises a scalloped hemline and bamboo/cotton knit fabric. In a preferred embodiment, the outer shell is a tank top, and the front portion of the bra comprises a left strap connected to the left tapered section and a right strap connected to the right tapered section. The left strap is attached to the tank top along its neckline and a left armhole, wherein the right strap is attached to the tank top along its neckline and a right armhole. The left tapered section and the tank top form a left opening to receive an insert for the left cup, and the right tapered section and the tank top form a right opening to receive an insert for the right cup. The inserts comprise removable and interchangeably sized inserts. The left cup and right cup both comprise one or more darts. As an alternative to a tank top, the outer shell can be selected from the group consisting of: a dress, a shirt, a blouse, a vest, a sweater, a coat, pajamas, a jacket, a halter top, and a bathing suit.

This garment improves comfort over currently available traditional bras, shapeliness over current versions of sports bras, and supportiveness over current versions of tank tops with built-in shelf bras. The construction of the built-in bra also eliminates the unkempt look of exposure of the bra strap underneath the exterior garment.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
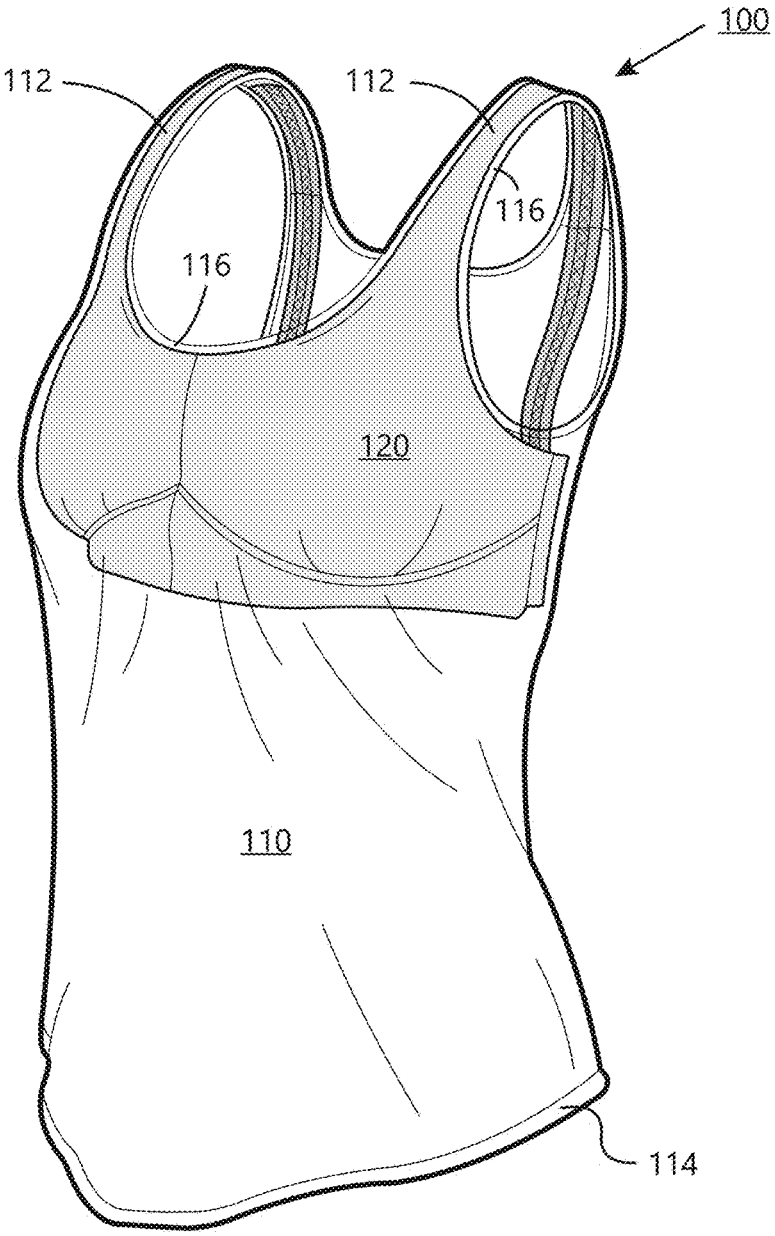
FIG. 1 illustrates a see-through view of a garment according to an embodiment of the invention.

Preferred embodiments of the present invention and their advantages may be understood by referring to FIGS. 1-13, wherein like reference numerals refer to like elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Moreover, the described features, structures, or characteristics of the invention may be combined in any suitable manner in one or more embodiments. It will be apparent to those skilled in the art that various modifications and variations can be made to the present invention without departing from the spirit and scope of the invention. For example, although the present invention is described in the context of a tank top, other types of garments, i.e., outer fabric shells, may be substituted for use with built-in breast support as described herein including, but not limited to a dress, a shirt, a blouse, a vest, a sweater, a coat, pajamas, a jacket, a halter top, and a bathing suit. Furthermore, the garment may utilize various types of necklines or sleeve lengths, the identification of which is apparent to one of ordinary skill in the art. Thus, it is intended that the present invention cover the modifications and variations of this invention provided they come within the scope of the appended claims and their equivalents. Reference will now be made in detail to the preferred embodiments of the invention.

Figure 2:
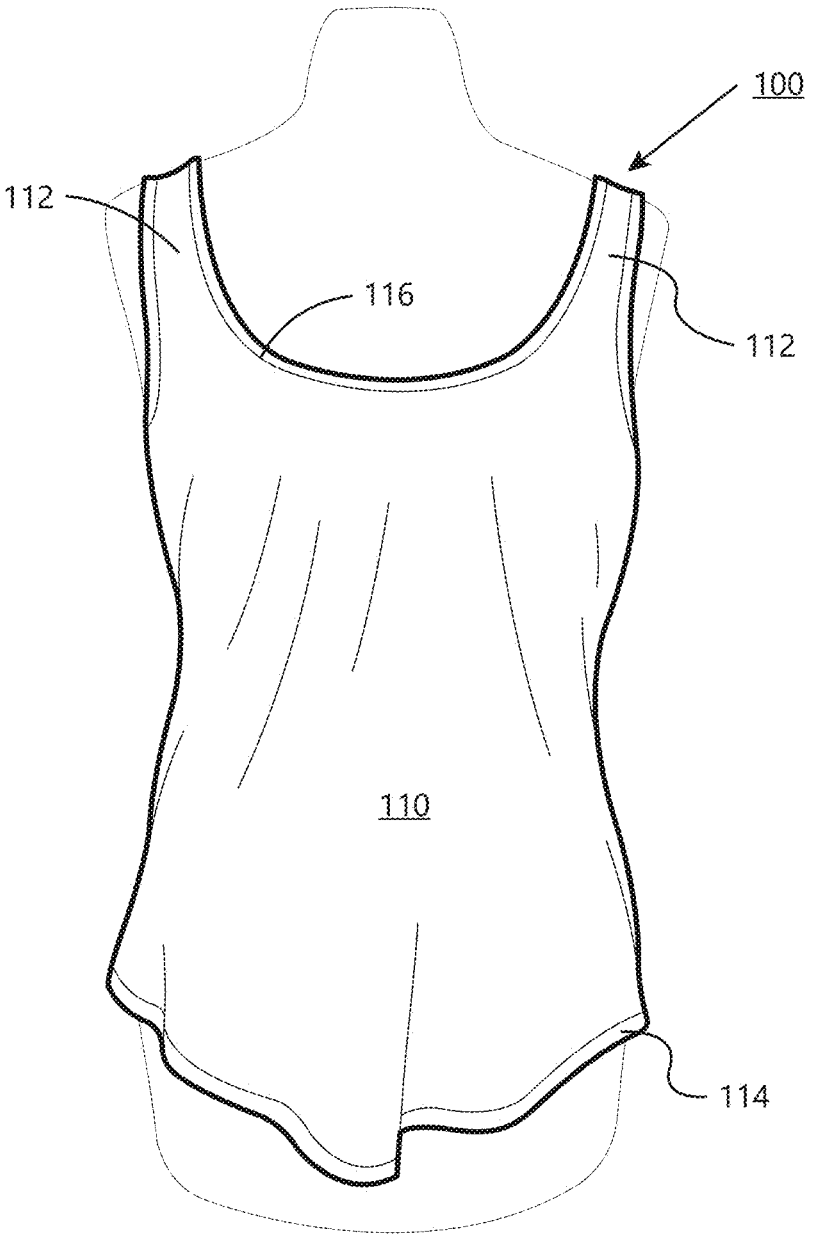
FIG. 2 illustrates a front view of the garment of FIG. 1.
Figure 3:
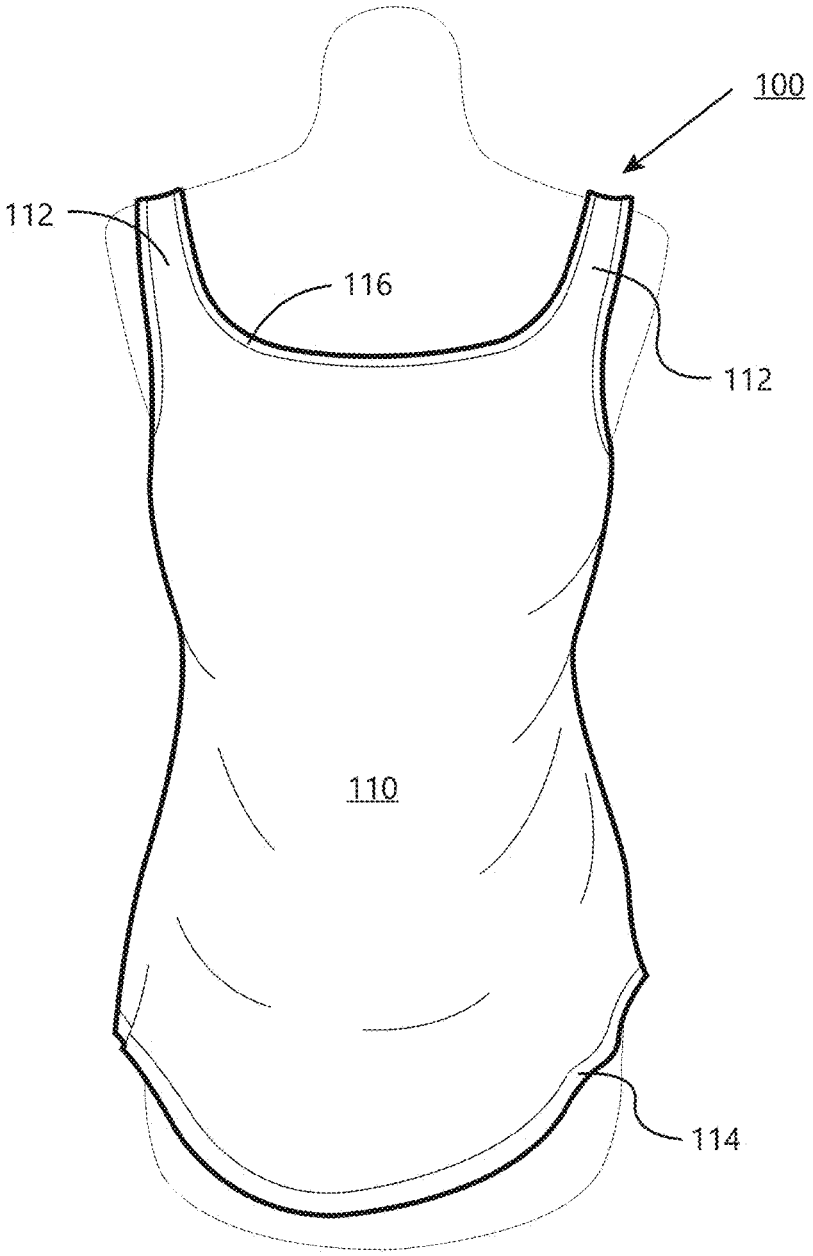
FIG. 3 illustrates a back view of the garment of FIG. 1.
Figure 4:
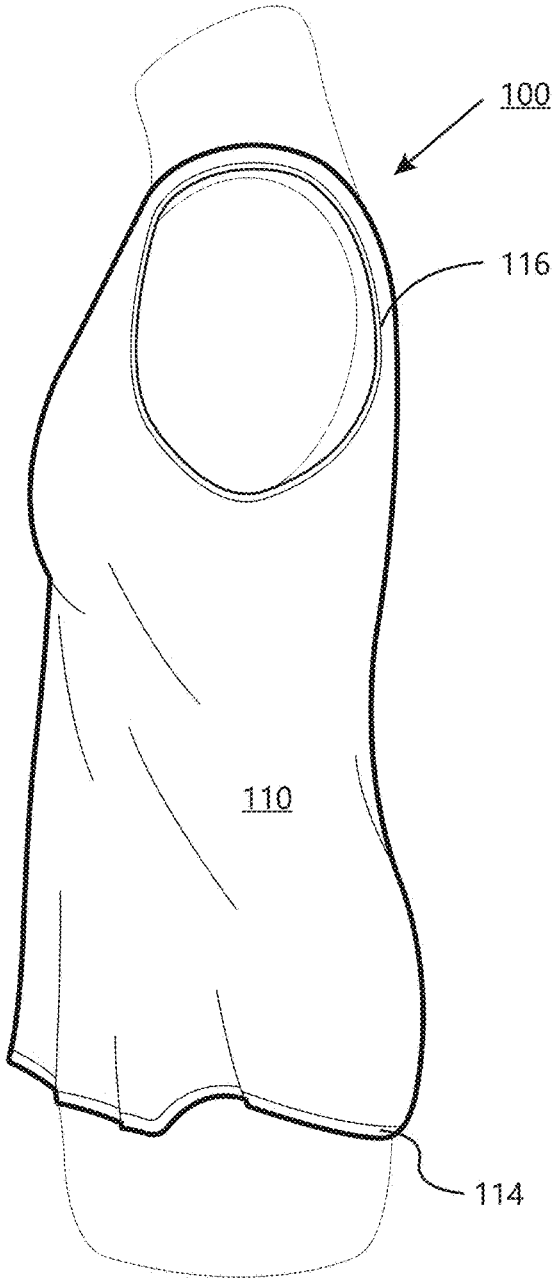
FIG. 4 illustrates a side view of the garment of FIG. 1.
Figure 5:
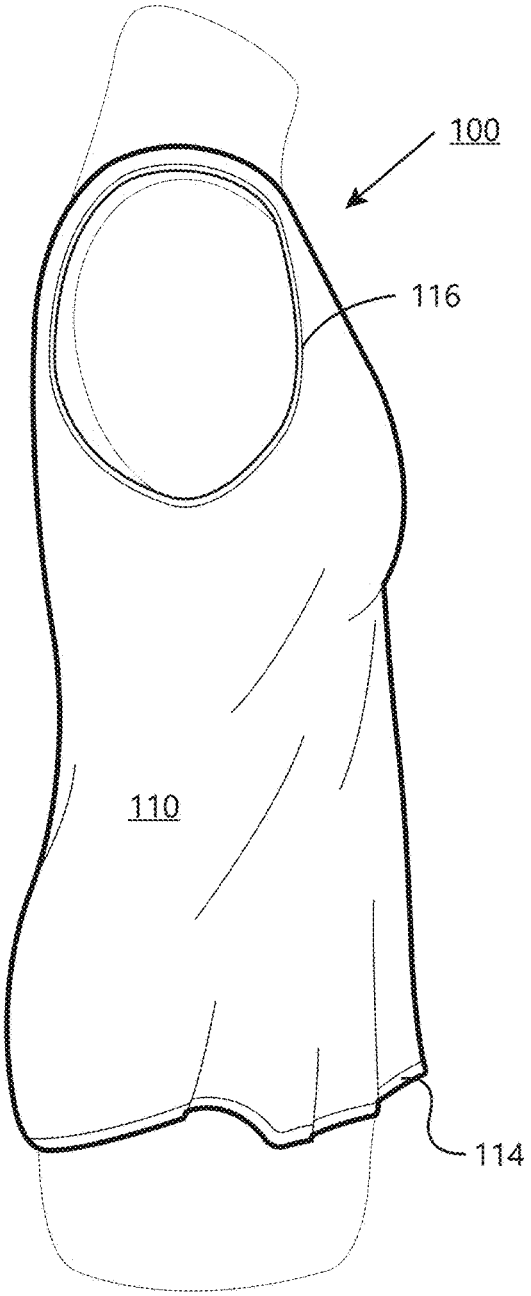
FIG. 5 illustrates another side view of the garment of FIG. 1.

FIGS. 1-5 illustrate a garment 100 according to an embodiment of the invention. The garment 100 comprises an outer fabric shell 110, e.g., tank top, having an independently suspended bra 120 secured on the inside. For illustration purposes only, the bra 120 is highlighted in FIG. 1 via gray shading and is shown through a see-through shell 110, which would otherwise be preferably opaque (or mostly opaque) and not transparent in practice. Light gray shading denotes a front portion of the bra 120. Dark gray shading denotes a back portion of the bra 120. FIGS. 2 and 3 illustrate respective front and back views of the garment 100. FIGS. 4 and 5 illustrate side views of the garment 100. The tank top 110 comprises left and right over-shoulder straps 112. In a preferred embodiment of the invention, the shoulder straps 112 are over-the-shoulder straps as shown, however other configurations of straps may be employed, the identification and implementation of which are apparent to one of ordinary skill in the art. The shoulder straps 112 and neckline include a binding 116 at the edges of the neckline and armholes.

The tank top 110 is preferably constructed from a cool, soft, naturally wicking fabric such as a bamboo/cotton knit, e.g., a 6 oz. 70/30 bamboo/cotton blend knit. However, other types of clothing materials may be used for the tank top 110 such as, but not limited any type of knit fabric, i.e., jersey, pique, jacquard, fleece, terry, thermal, or interlock, made from natural or man-made fibers, e.g., cotton, linen, polyester, nylon, spandex, or any combination thereof. The tank top 110 further comprises a figure-flattering scalloped hemline 114 providing ample length with enough coverage so it will not ride up when worn.

Figure 6A:
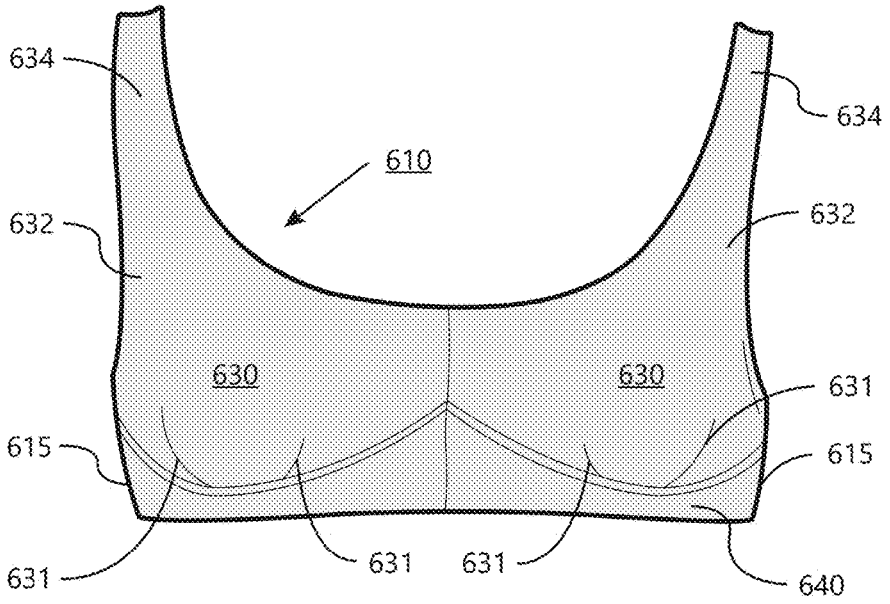
FIG. 6A illustrates a front view of a front bra portion of the garment of FIG. 1.
Figure 6B:
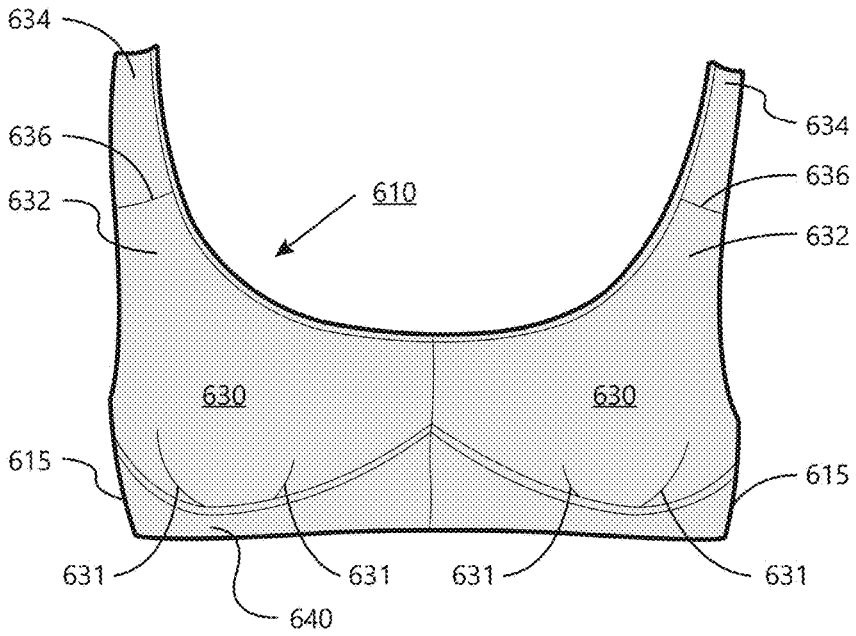
FIG. 6B illustrates a back (or inside-out) view of the front bra portion of FIG. 6A.
Figure 7:
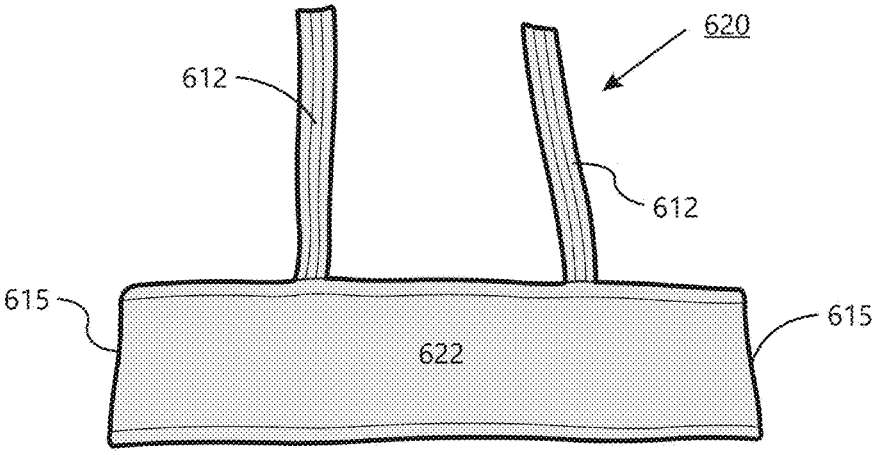
FIG. 7 illustrates a back bra portion of the garment of FIG. 1.

The bra 120 is incorporated within the tank top 110. Referring to FIGS. 6A, 6B, and 7, which show the bra 120 removed from the tank top 110, the bra 120 comprises a front portion 610 and a back portion 620. The front portion 610 and the back portion 620 are attached to one another at underarm boundaries 615 via stitching or an alternative securing mechanism such as, but not limited to a VELCRO hook and loop fastener, to form a unitary, circumferential, one-piece bra. In a preferred embodiment, the front portion 610 is constructed from the same material as the tank top 110, e.g., a 6 oz. 70/30 bamboo/cotton blend knit, and not from compression fabric. Constructing the front portion 610 of the bra 120 from the same material as the tank top 110 provides improved comfort and support, and is aesthetically pleasing.

Referring to FIG. 6A (showing a front view of the front portion 610 without the back portion 620), the front portion 610 of the bra 120 comprises left and right bra cups 630, and a bridge 640. The front portion 610 is darted along the bottom of bra cups 630 to accommodate a woman's breasts when worn. For example, each bra cup 630 comprises one or more darts 631 (two are shown in each cup 630 in the exemplary embodiment of FIG. 6). Darts 631 are folds, i.e., tucks coming to a point, and sewn into fabric to take in ease and provide shape. The darts 631 in the front portion 610 of the bra 120 and the shape of the bridge 640 help provide support underneath a women's breasts and also create independent support for each breast (unlike sports bras or shelf bras that create a "uni-boob" configuration). Each double-layered cup 630 tapers at the top to form an intermediate tapered section 632. The sections 632 are created by extension of the double-layered shell fabric that forms the bra cups 630. The double-layered thickness of the fabric creates additional structure to help lift and support the wearer's breasts. The bra cups 630 are double-layered to accommodate an optional foam insert (shown in FIG. 9) selected from a range of different sizes based on amount of coverage needed. The optional inserts provide additional breast support, help even out breast shape, and form and provide nipple coverage. The inserts may comprise a flexible material such as, but not limited to foam, fabric, silicon, gel, or any combination thereof. The outside layer of the double-layered cup 630 and intermediate tapered section 632 proceeds to a strap 634, which is preferably constructed from the same material as the tank top 110.

Referring to FIG. 6B (showing a back view of the front portion 610 without the back portion 620), an opening 636 behind each section 632 is shown, by which the optional inserts may be placed there through into a respective cup 630. The opening is formed by the inside layer (touching the skin) of the double-layered cup 630 and the outside layer of the double-layered cup 630, the tapered section 632, and the strap 634. In other words, the outside fabric layer of the front portion 610 of the bra 120 exists at the cup 630, the intermediate tapered section 632, and the strap 634. The inside fabric layer of the front portion 610 of the bra 120 exists at the cup 630, the intermediate tapered section 632, but not the strap 634, thereby leaving the opening 636. In an alternative embodiment of the invention, the straps are optional and the top of the front portion 610 of the bra 120 ends at the intermediate tapered sections 632.

Referring to FIG. 7 (showing a back view of the back portion 620 without the back portion 610), the back portion 620 comprises two back straps 612 and a back panel 622. The back straps 612 and the back panel 622 are constructed from compression fabric to create a soft, but structured elastic band for flexibility and support. For example, the compression fabric stretches to accommodate to putting on and taking off of the garment, but recovers and contracts to its original length during wearing. In an exemplary embodiment, the compression fabric is 90/10 cotton/elastane or stretch knit. The back straps 612 are adjoined to the back panel 622 via stitching. The back panel 622 of the bra 120 is made from a one band piece of compression-like fabric with finished edges on the top and bottom. The back shoulder straps 616 are similarly formed from the same fabric folded into a tube and flat-locked stitched to provide additional structure. The straps 612 are wider than traditional bra straps. This distributes the weight more evenly and the flat-locked stitching eliminates adjusters and clasps to avoid discomfort, irritation, unsightliness and bulging of conventional shoulder straps.

Figure 8:
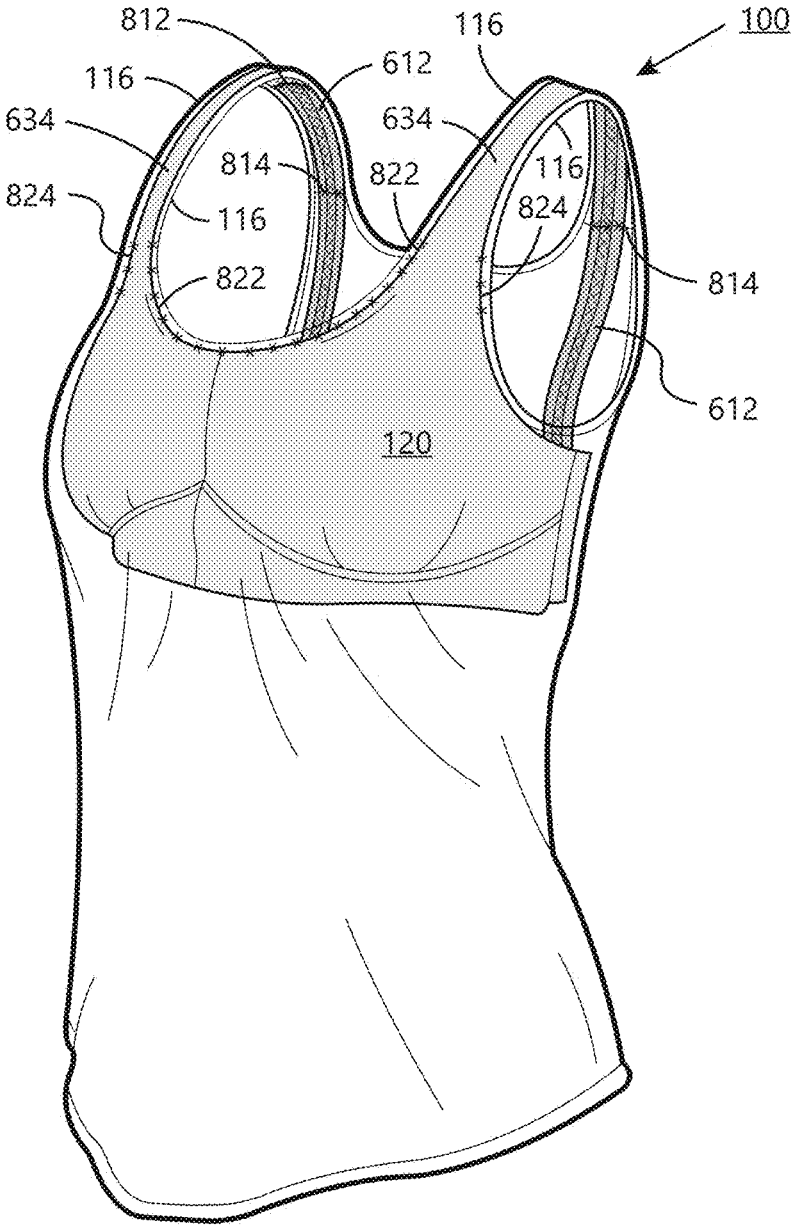
FIG. 8 illustrates a see-through view of the garment of FIG. 1 highlighting stitching of the bra to the tank top.

FIG. 8 highlights the areas where the tank top 110 is attached to the bra 120 according to an exemplary embodiment of the invention. A top end of each back strap 612 of the bra 620 is affixed to a top back shoulder portion of a shoulder strap 112 of the tank top 110 via stitching 812. Alternatively, the stitching may occur at the very top or at a top front shoulder portion of the shoulder strap 112. The stitching 812 is located along the width (between the neckline and armhole) of the back strap 612 and shoulder strap 112. Each back strap 612 is loosely held in place by a loop 814 provided on the inner surface of the shoulder strap 112 at a location below the stitching 812, but above the back neckline of the tank top. This permits a back strap 612 to expand or contract while remaining hidden under the shoulder strap 112.

The outside fabric layer and inside fabric layer of the top edge of the front bra cups 630 and inner edges of tapered sections 632 are affixed to the tank top 110 at the lower front portion of a shoulder strap 112 along the neck line via stitching 822. The outside fabric layer and inside fabric layer of the tapered sections 632 are affixed to the tank top 110 at the lower front portion of a shoulder strap 112 along the armhole via stitching 824. The front straps 634 of the bra 120 are affixed to the tank top straps 112 at the bindings 116 along the neckline and armholes. Since the bottom edge of the front portion 610 as well as the back panel 622 are not affixed to the tank top shell 110, this permits independence or "floating" of the bra 120 relative to the tank top 110.

In the case where the garment 110 is not a tank top, e.g., the garment 110 includes sleeves, the front straps 634 of the bra 120 can be affixed to the garment at or near the neckline and armholes. Stitching 822 may not be necessary when a higher neckline is present, e.g., a jewel, a scoop, or a boat.

Figure 9:
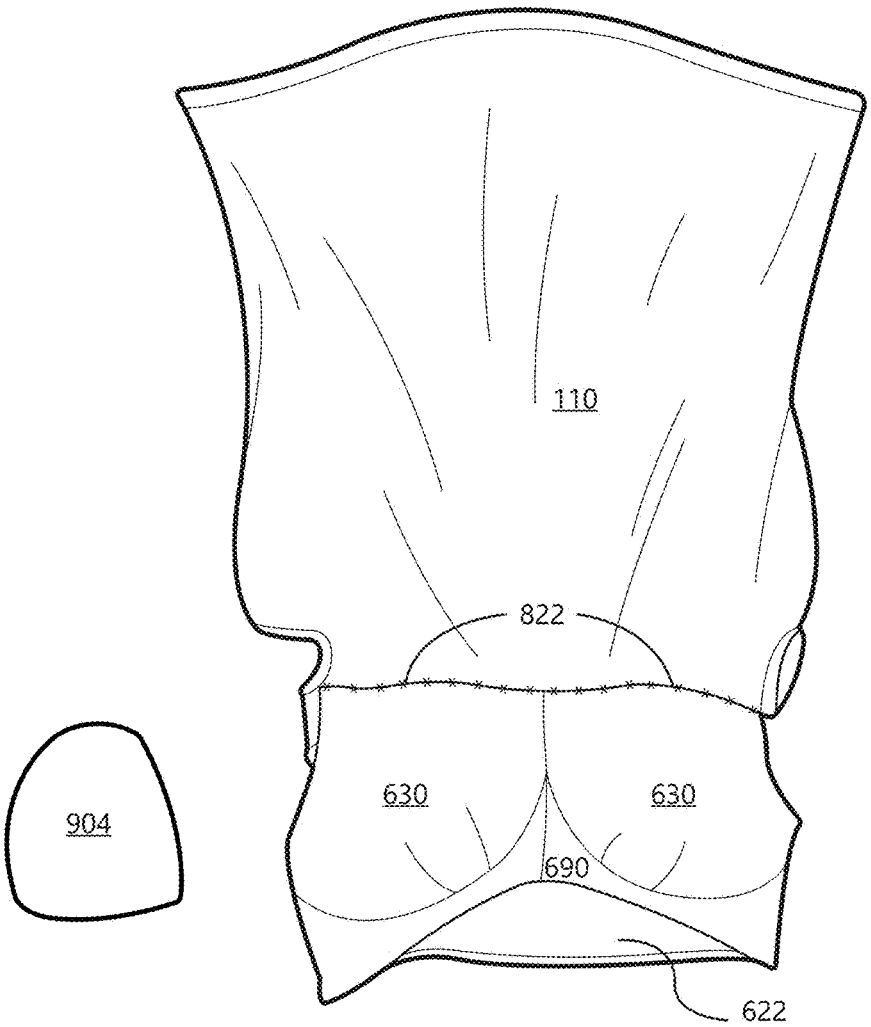
FIG. 9 illustrates an inside-out, freely hanging front view of the garment of FIG. 1.
Figure 10:
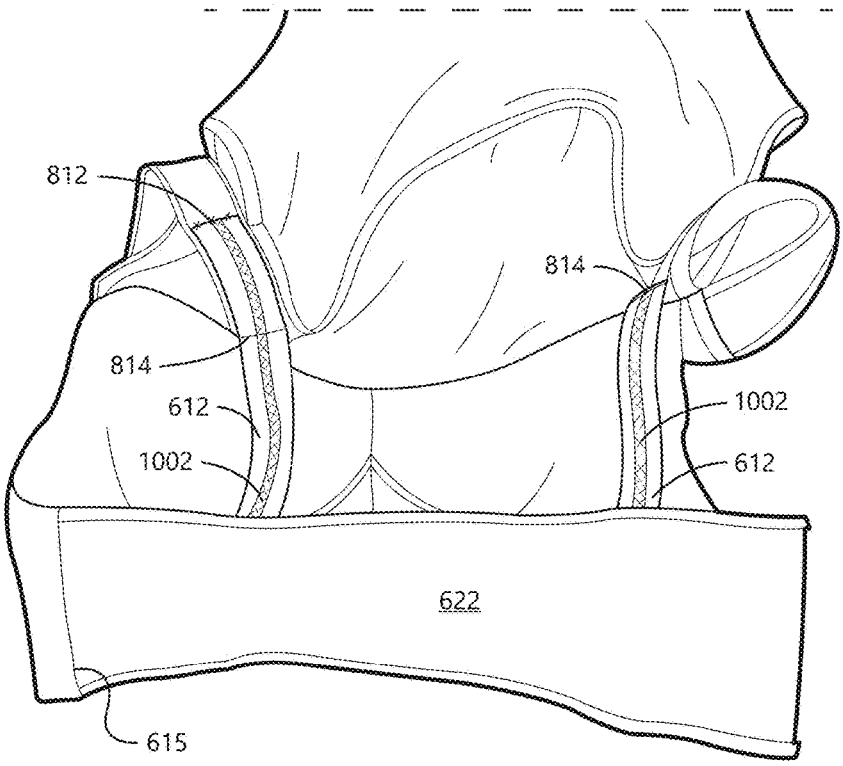
FIG. 10 illustrates an inside-out, freely hanging back view of the garment of FIG. 1.
Figure 11:
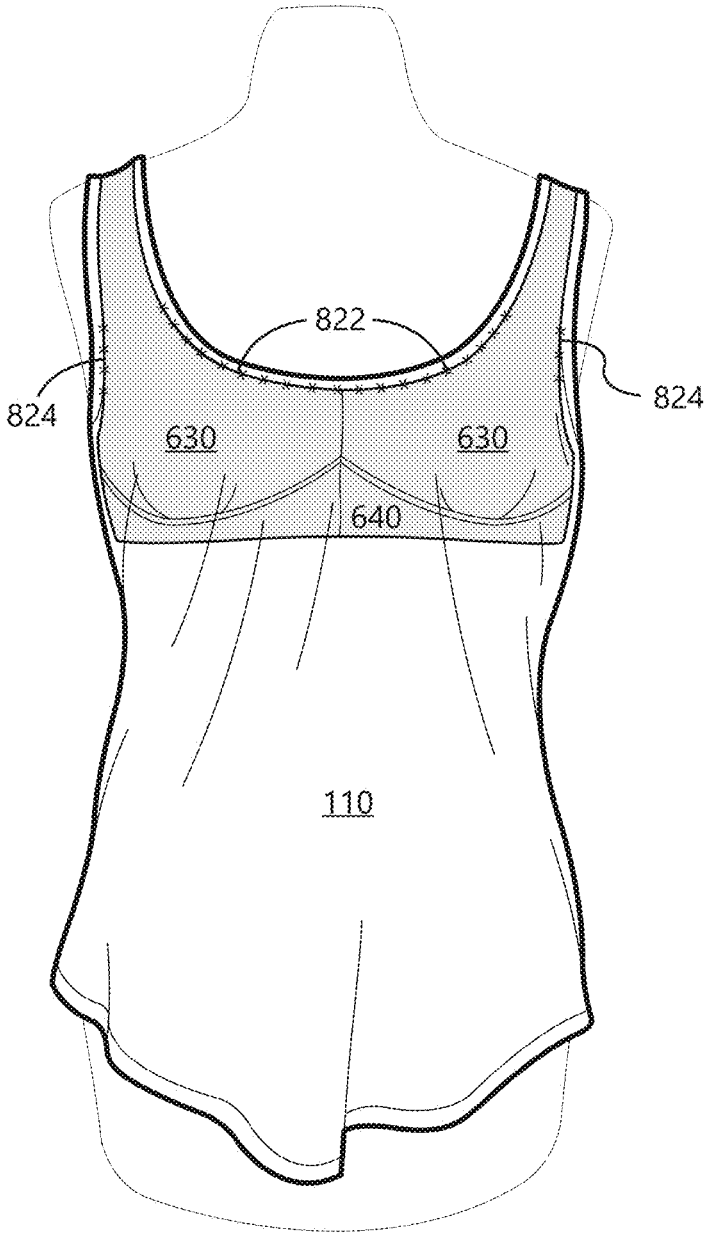
FIG. 11 illustrates an inside-out, worn front view of the garment of FIG. 1.
Figure 12:
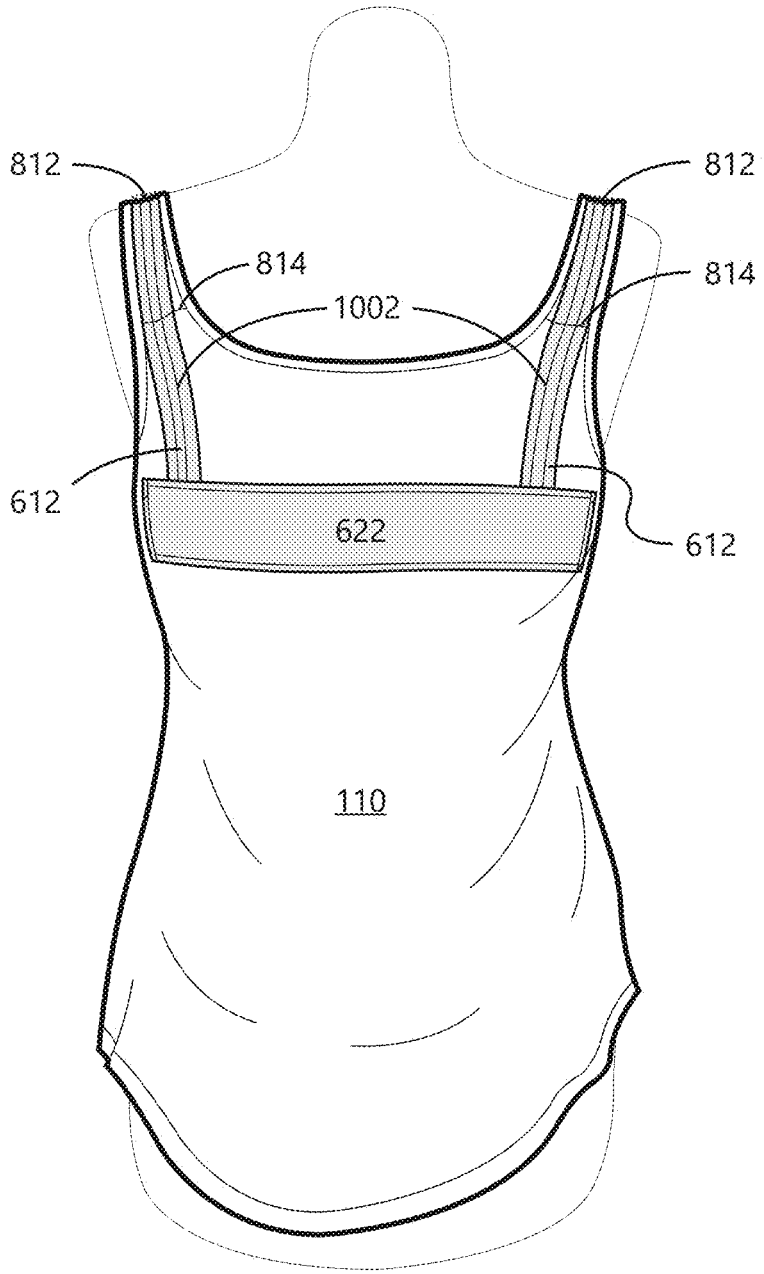
FIG. 12 illustrates an inside-out, worn view of the garment of FIG. 1.

FIGS. 9-12 illustrate the garment 100 inside-out to better depict the components of the bra 120. Particularly, FIG. 9 illustrates a front view of the garment 100 inside-out, freely hanging. Here, the configuration of the cups 630, tank top 110, and stitching 822 form an opening 902. An insert 904 for the bra cups 630 is also shown. FIG. 10 illustrates a back view of the garment 100 inside-out, freely hanging. Here, the affixing of back straps 612 to the tank top 110 is shown via stitching 812 and loops 814. Optional stitching 1002 can be provided for knit garments to allow for the knit fabric to flex. FIG. 11 illustrates a front view of the garment 100 inside-out and worn. Once the darts are sewn, the bra is stitched to the bridge 640 and then the binding is sewn over top of inside seam. FIG. 12 illustrates a back view of the garment 100 inside-out and worn.

The woman's tank top garment 110 of the present invention offers numerous advantages over garments heretofore used. It eliminates the need for a woman to wear a separate bra in combination with a tank top. Moreover, it provides a lightweight, cool, non-cumbersome garment designed for active use while still providing a degree of support for a woman's bust. The darts built in to the design of the bra cups, in combination with the fabric bridge provides independent support for a wearer's breasts while still maintaining a "natural" look.

Figure 13:
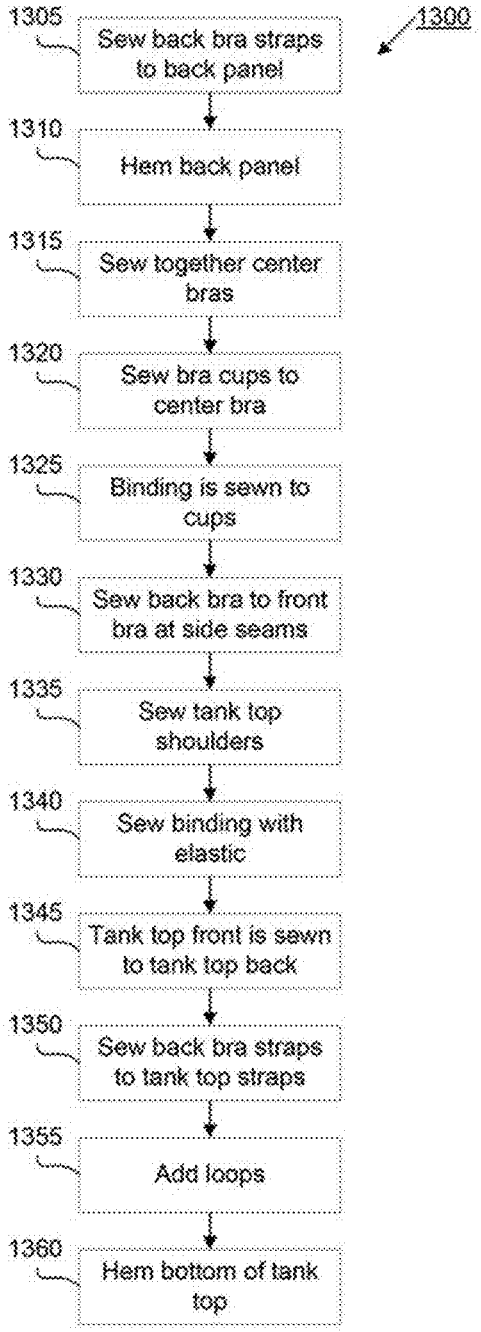
FIG. 13 illustrates a manufacturing method of creating a garment according to an exemplary embodiment of the invention.

From a manufacturing standpoint, the garment is easily assembled. FIG. 13 illustrates a method 1300 for manufacturing the garment 100 according to an exemplary embodiment of the invention. Pattern pieces comprise the following: two (2) back bra straps 612, a back panel 622, two (2) outside bra cup sections (i.e., the outside bra cup layer that does not touch the wearer's body), two (2) inside bra cup sections (i.e., the inside bra cup layer that touches the wearer's body), two (2) center bra sections (i.e., the forms bridge 640), a garment front, and a garment back. Bra straps 612 are created by folding the strap piece edges to the center and performing an overlock stitch to finish. The bra straps 612 are sewn (step 1305) to the back panel 622. The back panel 622 is hemmed (step 1310) at the top and bottom with a ¼ inch cover stitch. The center bra sections are sewn (step 1315) together. The bra cups are then sewn (step 1320) to the center bra. The top of the inside bra cup layer is hemmed to create an opening. The binding is sewn (step 1325) to the bottom cups. The front bra and back bra are then sewn (step 1330) together at side seams with a clean finish. The bra is attached to the garment front by matching notches, the implementation of which is apparent to one of ordinary skill in the art. The notches can be cut into the fabric or extend beyond to help position the pieces for sewing. The front tank top strap is sewn (step 1335) to the back strap at the shoulders to connect the garment. The binding is sewn (step 1340) with clear elastic inside. The garment front is sewn (step 1340) to garment back. The back bra straps are sewn (step 1345) to shoulder straps of garment. Loops 814 are added (step 1350) to back straps. The bottom of the garment is then hemmed (step 1355) with ¼ inch cover stitch.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

We claim:

1. An article of clothing comprising:

an outer shell comprising a left over-shoulder strap and a right over-shoulder strap; and an inner bra comprising a front portion and a back portion;

the front portion comprises: a left cup, a right cup, a bridge connected to the left cup and the right cup, a left tapered section above the left cup, a right tapered section above the right cup;

the back portion comprises: a back panel, a first back strap comprising a proximate end and a distal end, and a second back strap comprising a proximate end and a distal end, wherein the back panel is connected to the proximate end of the first back strap and the proximate end of the second back strap;

wherein the left tapered section of the inner bra is connected to a lower front portion of the left over-shoulder strap of the outer shell along a neckline and a left armhole, and the right tapered section of the inner bra is connected to a lower front port of the right over-shoulder strap of the outer shell along a neckline and a right armhole; and wherein the distal end of the first back strap is connected to the left over-shoulder strap of the outer shell, and the distal end of the second back strap is connected to the right over-shoulder strap of the outer shell, and a first loop attached to a back shoulder portion of the left over-shoulder strap and a second loop attached to a back shoulder portion of the right over-shoulder strap, the first loop loosely holding in place the first back strap, and the second loop loosely holding in place the second back strap.

2. The article of clothing of claim 1, wherein the first back strap and the second back strap both comprise compression fabric or stretch knit fabric, and the outer shell and the front portion of the inner bra do not comprise compressive fabric.

3. The article of clothing of claim 1, wherein the outer shell comprises a scalloped hemline.

4. The article of clothing of claim 1, wherein the outer shell comprises a bamboo/cotton knit fabric.

5. The article of clothing of claim 1, wherein the outer shell is a tank top, and the front portion of the bra comprises a left strap connected to the left tapered section and a right strap connected to the right tapered section.

6. The article of clothing of claim 5, wherein the left strap is attached to the tank top along its neckline and left armhole, wherein the right strap is attached to the tank top along its neckline and right armhole.

7. The article of clothing of claim 6, wherein the left tapered section and the tank top form a left opening to receive an insert for the left cup, and the right tapered section and the tank top form a right opening to receive an insert for the right cup.

8. The article of clothing of claim 7, wherein the inserts comprise removable and interchangeably sized inserts.

9. The article of clothing of claim 1, wherein the left cup and right cup both comprise one or more darts.

10. An article of clothing comprising:

an outer shell; and an inner bra comprising a front portion and a back portion;

the front portion comprises: a left cup, a right cup, a bridge connected to the left cup and the right cup, a left tapered section above the left cup, a right tapered section above the right cup;

the back portion comprises: a back panel, a first back strap comprising a proximate end and a distal end, and a second back strap comprising a proximate end and a distal end, wherein the back panel is connected to the proximate end of the first back strap and the proximate end of the second back strap;

wherein the left tapered section of the inner bra is connected to the outer shell, and the right tapered section of the inner bra is connected to the outer shell;

wherein the distal end of the first back strap is connected to the outer shell, and the distal end of the second back strap is connected to the outer shell; and wherein the bridge and the back panel are not connected to the outer shell and are free to float relative to the outer shell.

11. The article of clothing of claim 10, wherein the first back strap and the second back strap both comprise compression fabric or stretch knit fabric, and the outer shell and the front portion of the inner bra do not comprise compressive fabric.

12. The article of clothing of claim 10, wherein the outer shell comprises a scalloped hemline.

13. The article of clothing of claim 10, wherein the outer shell comprises a bamboo/cotton knit fabric.

14. The article of clothing of claim 10, wherein the outer shell is a tank top, and the front portion of the bra comprises a left strap connected to the left tapered section and a right strap connected to the right tapered section.

15. The article of clothing of claim 14, wherein the left strap is attached to the tank top along a neckline and a left armhole, wherein the right strap is attached to the tank top along a neckline and a right armhole.

16. The article of clothing of claim 15, wherein the left tapered section and the tank top form a left opening to receive an insert for the left cup, and the right tapered section and the tank top form a right opening to receive an insert for the right cup.

17. The article of clothing of claim 16, wherein the inserts comprise removable and interchangeably sized inserts.

18. The article of clothing of claim 10, wherein the left cup and right cup both comprise one or more darts.

* * * * *